US006827755B2

(12) United States Patent
Taguchi et al.

(10) Patent No.: US 6,827,755 B2
(45) Date of Patent: Dec. 7, 2004

(54) HIGH-TOUGHNESS AND HIGH-STRENGTH FERRITIC STEEL AND METHOD OF PRODUCING THE SAME

(75) Inventors: Masami Taguchi, Ube (JP); Ryo Ishibashi, Hitachi (JP); Yasuhisa Aono, Hitachi (JP); Hidehiko Sumitomo, Ube (JP); Hiroki Masumoto, Fukuoka (JP); Masakuni Fujikura, Nagoya (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/187,367

(22) Filed: Jul. 2, 2002

(65) Prior Publication Data

US 2003/0133824 A1 Jul. 17, 2003

(30) Foreign Application Priority Data

Sep. 21, 2001 (JP) ..... 2001-289502

(51) Int. Cl.[7] ..... C22C 33/02

(52) U.S. Cl. ..... 75/236; 75/238; 75/246; 419/11; 419/29; 419/32; 419/48

(58) Field of Search ..... 75/243, 244, 246, 75/236, 238; 419/11, 29, 32, 48

(56) References Cited

U.S. PATENT DOCUMENTS

| | | | | |
|---|---|---|---|---|
| 4,139,377 A | | 2/1979 | Bergh et al. | 75/243 |
| 4,963,200 A | | 10/1990 | Okuda et al. | 148/325 |
| 5,462,808 A | * | 10/1995 | Asabe et al. | 428/551 |

FOREIGN PATENT DOCUMENTS

| | | |
|---|---|---|
| EP | 1 234 894 | 8/2002 |
| JP | A-2000-17370 | 1/1990 |
| JP | A-2000-17405 | 1/1990 |
| JP | A-2000-96193 | 4/1990 |
| JP | A-2000-104140 | 4/1990 |
| JP | 7-90303 | 4/1995 |
| JP | 7-90468 | 4/1995 |
| JP | 7-90470 | 4/1995 |
| JP | 10-60527 | 3/1998 |
| JP | 2000-096193 | 4/2000 |
| JP | 2000-214282 | 8/2000 |

OTHER PUBLICATIONS

European Search Report mailed Jan. 2, 2003, for EP 02 01 4974.

* cited by examiner

*Primary Examiner*—Ngoclan T. Mai
(74) *Attorney, Agent, or Firm*—Antonelli, Terry, Stout & Kraus, LLP

(57) ABSTRACT

A high-strength and high-toughness ferritic steel having a tensile strength of not less than 1,000 MPA and a Charpy impact value of not less than 1 $MJ/m^2$ is provided. A ferritic steel comprising, by weight, not more than 1% Si, not more than 1.25% Mn, 8 to 30% Cr, not more than 0.2% C, not more than 0.2% N, not more than 0.4% O, a total amount of not more than 12% of at least one compound-forming element selected from the group of Ti, Zr, Hf, V and Nb in amounts of not more than 3% Ti, not more than 6% Zr, not more than 10% Hf, not more than 1.0% V and not more than 2.0% Nb, also containing where necessary not more than 0.3% Mo, not more than 4% W and not more than 1.6% Ni, and the balance consisting of Fe and unavoidable impurities, and having an average crystal grain size of not more than 1 μm, can be obtained by a method comprising encapsulating a steel powder produced by mechanical alloying, and subjecting the encapsulated steel powder to plastic deformation.

28 Claims, 3 Drawing Sheets

HIGH-TOUGHNESS AND HIGH-STRENGTH FERRITIC STEEL AND METHOD OF PRODUCING THE SAME

BACKGROUND OF THE INVENTION

1. Field of the Invention

The present invention relates to a novel ferritic steel having high strength and high toughness, and a method of producing the same.

The ferritic steel of the invention has high durability in corrosive or stress loading environments and is suited for use for the manufacture of power-generating turbine parts, nuclear fuel cladding pipes, automobile mufflers and so on.

2. Description of the Prior Art

Among the ferrous materials, ferritic steel has the advantage not found in austenitic steel that it is resistant to stress corrosion cracking and low in thermal expansion coefficient, so that it is widely used as a material of structural components.

In recent years, there has been an increasing rise of demand for higher performance and smaller weight of products, so that even higher strength of structural materials has been desired. The conventional techniques for strengthening structural materials such as quenching and tempering heat treatment, solid-solution strengthening by an addition of alloying elements and precipitation strengthening had the problem of their tendency to cause deterioration of toughness of the produced material, and low toughness of the material has been a serious restriction on product designing. Recently, the researchers have pursued studies in earnest on grain refinement strengthening known as a material strengthening technique which causes no deterioration of toughness, and now it is possible to obtain a steel material having ultrafine crystal grains with an average grain size of not greater than 1 $\mu$m.

The powder metallurgy method adopting a mechanical grinding process such as mechanical alloying has made it possible to make large scale components, allowed enlargement of the degree of freedom of shaping after consolidation, and enabled refining of crystal grains to the nanometer order by mechanical pulverization, making it possible to obtain a high strength ultrafine grain structure with a grain size of several hundred nanometers depending on the consolidation process.

In order to obtain an ultrafine grain structure, it has been proposed and practiced to introduce dispersed particles which suppress the growth of crystal grains during consolidation. Carbides or oxides are used as dispersed particles, and one example using carbides is disclosed in JP-A-2000-96193. Also, examples using oxides are described in JP-A-2000-104140, JP-A-2000-17370 and JP-A-2000-17405.

JP-A-2000-17405 discloses a method of producing a high strength ultrafine grain steel containing $SiO_2$, MnO, $TiO_2$, $Al_2O_3$, $Cr_2O_3$, CaO, TaO and $Y_2O_3$. The role of the oxide-forming alloying elements is substantially defined to the supply of dispersed particles, and their amount is limited as excess precipitation results in a deterioration of toughness.

JP-A-2000-17370 describes a method of producing a high strength ultrafine grain steel directly from iron ore or iron sand by powder metallurgy method applying the mechanical alloying technique, and it states that since $SiO_2$, $Al_2O_3$, CaO, MgO and $TiO_2$ in the raw powder are refined by mechanical alloying or finely precipitated during consolidation, it is possible to control the growth of crystal grains while making harmless the otherwise adverse effect of the oxides on mechanical properties of the produced steel.

JP-A-2000-17370 teaches also that it is possible to improve properties by adding one or more elemental powders of Al, Cu, Cr, Hf, Mn, Mo, Nb, Ni, Ta, Ti, V, W and Zr during mechanical alloying, but it is silent on effective amounts of the powders to be added and the properties to be improved.

As the effect of grain refining on toughness, it is known that the ductile-brittle transition temperature (DBTT) is lowered by such refining, and it has been reported that DBTT could be made lower than the liquid nitrogen temperature in the steel material having its crystal grains refined by thermomechanical treatment employing rolling vis-à-vis the material produced by melting/casting. However, with the art of powder metallurgy, it is difficult to attain high toughness simply by refining of crystal grains due to the brittlement factors such as particle boundaries of a starting powder and dispersed particles. Herein, the term "starting powder" means the powder produced by mechanical alloying.

SUMMARY OF THE INVENTION

Object of the Invention

An object of the present invention is to produce a ferritic steel having high strength and high toughness by powder metallurgy method making use of mechanical alloying techniques and to provide a novel ferritic steel having high strength and high toughness.

Statement of the Invention

According to the present invention, at least one compound-forming element selected from the group consisting of Zr, Hf, Ti and V is added when producing a ferritic steel powder by mechanical alloying.

The compound-forming elements are combined with O, C and N originally contained in the ferritic steel powder or getting mixed therein from the atmosphere to form a carbide, an oxide and a nitride, respectively, in the course of consolidation of the ferritic steel powder produced by mechanical alloying. The formed compounds function as pinning particles for controlling the growth of crystal grains to improve toughness of the consolidated ferritic steel.

The invention ferritic steel contains, by weight, not more than 1% Si, not more than 1.25% Mn, 8 to 30% Cr, not more than 0.2% C, not more than 0.2% N, not more than 0.4% O, and a total amount of not more than 12% of at least one compound-forming element selected from the group consisting of Ti, Zr, Hf, V and Nb in amounts of not more than 3% Ti, not more than 6% Zr, not more than 10% Hf, not more than 1.0% V and not more than 2.0% Nb. It may optionally further contain not more than 3% Mo, not more than 4% W and not more than 6% Ni. The balance consists of Fe and unavoidable impurities. The invention ferritic steel has an average crystal grain size of not more than 1 $\mu$m after consolidation.

The compound-forming element contained in the invention ferritic steel is preferably at least one selected from Ti, Zr and Hf, and it is particularly preferable that at least one of Ti, Zr and Hf be contained in amounts of not more than 3% Ti, not more than 6% Zr and not more than 10% Hf for a total amount of not more than 12%.

These compound-forming elements exist in the form of carbide, nitride and oxide in the consolidated ferritic steel.

The total content of O, C and N in the consolidated ferritic steel is a key factor for obtaining a ferritic steel having high strength and high toughness. It is desirable that the total content of O, C and N is not more than 66% by weight of the total content of Zr, Hf and Ti. In the case where Zr and Hf are contained as the compound-forming elements, the total content of O, C and N is preferably not more than 66% by weight of the total content of Zr and Hf.

According to the present invention, there are provided ferritic steels containing any one of Zr, Hf and Ti respectively as the compound-forming element, a ferritic steel containing all of Zr, Hf and Ti, a ferritic steel containing Zr and Hf, and a ferritic steel containing all of Zr, Hf, Ti, V and Nb.

The invention ferritic steel can be produced by encapsulating the steel powder produced by mechanical alloying, and subjecting the encapsulated steel powder to plastic deformation working.

The plastic deformation working is preferably carried out at a temperature of 700° C. to 900° C. The plastic deformation working can be effected by such a method of extrusion or hydrostatic pressing. Extrusion is preferably conducted in an extrusion ratio of 2 to 8, and hydrostatic pressing is preferably performed under a hydrostatic pressure of 190 MPa or higher. Preferably, hydrostatic pressing is followed by forging.

It is also desirable to conduct, after plastic deformation, a heat treatment for heating the work at 600° C. to 900° C. under a hydrostatic pressure of 10 to 1,000 MPa as this treatment contributes to the further enhancement of toughness.

In encapsulation of the steel powder produced by mechanical alloying, the capsules filled with the powder are preferably evacuated.

Before the encapsulation, the steel powder may be subjected to a heat treatment at a temperature from 200° C. to lower than 700° C. for 1 to 10 hours.

In the ferritic steel producing method of the invention, when the raw powders are mixed and subjected to mechanical alloying, the whole or part of at least one compound-forming element selected from Zr, Hf, Ti, V and Nb is preferably used in the form of an elemental powder and mixed with other alloy steel powders. Although the compound-forming elements of Zr, Hf, Ti, V and Nb may be used in the form of a compound, it is desirable to use an elemental powder of a compound-forming element(s) or a pre-alloyed powder containing a compound-forming element(s) when producing the mechanically alloyed ferritic steel.

The present inventors have revealed that when producing steel by the powder metallurgy method, gaseous substances of O (oxygen), C (carbon) and N (nitrogen) give a great influence to ductility and toughness of the product steel. The gaseous substances, beside those derived from the raw powders, include those brought in from the atmosphere during the course of mechanical pulverization of the raw powders. They may also be derived from the working tools. The excessive gaseous substances form non-metallic inclusions on the powder particle surfaces. Such non-metallic inclusions impair metal to metal bonding of the powders to greatly deteriorate ductility and toughness of the consolidated steel.

In the present invention, the gaseous substances of O, C and N are combined with the compound-forming elements such as Zr, Ti and Hf to form compounds which function as pinning particles for suppressing the crystal grain growth.

Herein below there will be provided a description on the metal structure, the chemical composition, and the production conditions in the present invention.

Cr is an element which serves for improving corrosion resistance of the invention steel, and is contained in an amount of preferably not less than 8 wt % in the steel. However, the Cr content should not exceed 30 wt % because the presence of the element in excess of 30 wt % may induce marked precipitation of the compounds which causes embrittlement of the product steel.

Zr, Hf and Ti combine with gaseous components of O, C and N to fix these, whereby the gaseous components are prevented to form non-metallic inclusions. Compounds between Zr, Hf or Ti, and O, C or N are very stable and finely dispersed in a matrix, and serve for pinning the grain boundary movement to suppress the crystal grain growth.

In the mechanical pulverizing process, inclusion of O and N from the atmosphere is unavoidable. Especially O is problematic as it exerts serious influence on the mechanical properties of the materials. Also, for the mechanical pulverizing process, it is necessary to use the working tools of a high strength material, for example, JIS SKD11 (AISI D2) or JIS SUJ2 (AISI 52100) with a high C content, which makes inclusion of C hardly avoidable.

The presence of free O, C and N included as impurities affects particle boundaries of the starting powder to cause embrittlement of the materials. Zr, Hf, and Ti act to inhibit the O, C and N from diffusing to particle boundaries of the starting powder and fix O, C and N in the form of oxides, carbides and nitrides in the powder, whereby they become the so-called pinning particles and contribute to suppression of growing of crystal grains, producing an effect of improving strength and toughness of the product steel.

The contents of Zr, Hf and Ti are mainly determined by the amounts of O, C and N after the mechanical pulverizing process. Inclusion of O, C and N during the mechanical pulverizing process can be suppressed to some extent by using a high-purity inert gas in gas atomization and mechanical pulverization processes. It is also effective to provide a coating on working tools such as balls for pulverization and/or the inner surface of a pulverization chamber prior to conducting the mechanical pulverizing process.

However, the amounts of the gaseous elements in the steel may be up to, by weight, 0.4% of O, 0.2% of C and 0.2% of N. Therefore, while their upper allowable limits are set at, by weight, 0.4% of O, 0.2% of C, and 0.2% of N, preferable contents are preferably 0.02 to 0.2% of O, preferably 0.002 to 0.15% of C and preferably 0.001 to 0.15% of N.

It is important to adjust the additive amounts of Zr, Hf and Ti so as to let the included elements O, C and N be quickly formed (precipitated) as Zr oxides (e.g. $ZrO_2$), Hf oxides (e.g. $HfO_2$), Ti oxides (e.g. $TiO_2$), Zr carbides (e.g. ZrC), Hf carbides (e.g. HfC), Ti carbides (e.g. TiC), Zr nitrided (e.g. ZrN), Hf nitrided (e.g. HfN) or Ti nitrides (e.g. TiN) during heating at consolidating, and not to embrittle the steel.

Zr, Hf and Ti are added with their upper limits set at, by weight, 6% (preferably 0.01 to 4%) for Zr, 10% (preferably 0.01 to 8%) for Hf, and 3% (preferably 0.01 to 2.7%) for Ti. For reducing the amount of expensive Hf, it is desirable to add a small amount of Hf together with Zr. This is because usually Zr ores contain approximately 2 to 3 wt % of Hf. It is therefore expedient to add Hf in a proportional amount of not more than 3 wt %, preferably 0.01 to 2 wt % to that of Zr.

In case of adding Zr, Hf and Ti at the same time, in view of the probability that the extraneous elements O, C and N might be contained in maximum amounts of, by weight, 0.4% for O, 0.2% for C and 0.2% for N, and that the steel could be embrittled by the excessive precipitation of the compounds, it is preferable to add the said elements (Zr, Hf and Ti) in a total amount of up to 12% by weight (preferably 0.01 to 8% by weight).

In order to make the entered elements O, C and N harmless in the consolidation process, the total amount of Zr, Hf and Ti is adjusted so that the value provided by dividing the sum of absolute amounts of O, C and N by the sum of absolute amounts of Zr, Hf and Ti will become less than 66 wt %, preferably less than 38 wt %.

In case of adding Zr and Hf alone at the same time, it is also desirable that their total amount be adjusted so that the value provided by dividing the sum of absolute amounts of O, C and N by the sum of absolute amounts of Zr and Hf will become less than 35% by weight, preferably less than 17% by weight.

Mo, W, Ni, V and Nb may be added for the purpose of improving the functional and mechanical properties of the product steel for use in various environments.

Mo and W are usually dissolved in the matrix and partly precipitated as carbides to serve for strengthening the product material. It is therefore effective to add these elements for strengthening the product material. They are also useful for improving heat resistance of the material particularly when it is used at a high temperature. Excessive addition of either of these elements is undesirable as it tends to provoke precipitation of intermetallic compounds which becomes a cause of embrittlement of the product material. When adding Mo, it is added in an amount not exceeding 3% by weight, preferably 0.5 to 1.5% by weight, and when adding W, it is added in an amount not exceeding 4% by weight, preferably 0.5 to 3% by weight, more preferably 1.0 to 2.5% by weight.

Ni is also usually dissolved in the matrix and serves for improving corrosion resistance. Its presence is therefore effective for improving corrosion resistance of the product material. Its excessive addition, however, should be avoided as it unstabilizes the ferrite phase. When Ni is added, its amount added is preferably 0.3 to 1.0% by weight, with its upper limit being 6% by weight.

V and Nb, when added to a steel material, are usually precipitated as carbides to serve for strengthening the material. They also have an action to control the growth of crystal grains.

Excessive addition of these elements, however, causes embrittlement of the material. When V is added, its preferred amount range is not more than 1.0% by weight, especially 0.05 to 0.5% by weight, and when Nb is added, its preferred amount range is not more than 2.0% by weight, especially 0.2 to 1.0% by weight.

When two or more of the above-mentioned five elements Zr, Hf, Ti, V and Nb are added simultaneously, it is desirable that their total amount be adjusted to be not more than 12% by weight for the purpose of controlling excessive precipitation of the oxide, carbide and nitride. When their total amount exceeds 12% by weight, the rate of precipitation of the oxide, carbide and nitride elevates to cause embrittlement of the product material.

Si and Mn are added as a deoxidizer in production of the material powder, Mn being also useful as a desulfurizer. The content of Si should be not more than 1% by weight and the content of Mn should be not more than 1.25% by weight in conformity to the Japanese Industrial Standards (JIS) of ferritic stainless steel. However, in case of using the high-purity materials as the components and vacuum melting them to make a powder, it is not necessary to add Si and Mn.

The mechanically pulverized alloy powder is encapsulated in the metallic capsules and extruded at 700° C. to 900° C. in an extrusion ratio of 2 to 8 to produce a bulk material having high compactness and toughness while maintaining fine crystal grains.

When the extrusion temperature is below 700° C., although the situation may vary depending on the extrusion ratio, there is a possibility to cause clogging, and also desired toughness may not be obtained due to accumulation of strain or other causes. The extrusion temperature, therefore, is preferably not lower than 700° C. When it exceeds 900° C., however, there may take place excessive growth of crystal grains, making it unable to obtain high strength of the product material. Therefore, the extrusion temperature is preferably 700° C. to 900° C.

When the extrusion ratio is less than 2, there may remain voids in the inside of the product material. On the other hand, when the extrusion ratio exceeds 8, separation tends to take place under the influence of fiber texture to lower toughness of the material. Clogging is also likely to occur. Thus, the preferred range of extrusion ratio is 2 to 8.

Even with the specimens which have been consolidated by giving plastic deformation to the powder to some extent, as in hot extrusion, after mechanical pulverization process, there are the occasions when the mechanical properties expected from the material structure can not be obtained under the restrictions of size and shape of the product or performance of the equipment. On such occasions, it is possible to improve toughness by a heat treatment under pressure of not lower than 10 MPa.

This is possible because, by the above heat treatment, the inter-particle connection is encouraged while controlling the growth of inter-particle compounds. When this heat treatment is conducted under a lower pressure, for example, under atmospheric pressure, the powder particle boundaries tend to become the compound-forming sites and may cause embrittlement of the product material.

Generally, the higher the pressure under which the heat treatment is conducted, the more desirable, but in view of the performance of the existing apparatus having a certain level of treating chamber capacity, the upper limit of pressure applicable is around 1,000 MPa. Therefore, pressure of the working atmosphere is preferably between 10 and 1,000 MPa.

In view of structural stability, it is desirable that the heat treatment be carried out basically at the consolidationtemperature or a lower temperature. For promoting inter-particle connection, the heat treatment is preferably carried out at a temperature not lower than 600° C. Thus, the preferred range of heat treatment temperature is from 600° C. to 900° C.

Even in case of forming the pinning particles of the same composition, viz. the same type, it is possible to control the crystal grain size of the matrix according to the heating pattern in the consolidation process.

It is considered that in the powder after mechanical pulverization, the composing elements O, C and N of the pinning particles are either in a state of being dissolved in the matrix or exist as oxides, carbides and nitrides which are so fine that they can hardly function as the pinning particles.

If heating is conducted rapidly in this state, there is a tendency for the crystal grains to grow before the pinning particles are sufficiently precipitated or grown. It becomes easier to obtain a fine crystal structure by maintaining the temperature at which the pinning particles can form or grow lively before raising the temperature to the consolidation temperature.

In the case of the invention chemical composition, it is possible to confirm the presence of oxides, carbides and nitrides through an electron microscope by holding the composition at not lower than 200° C. for one hour or more. When the composition is held at not lower than 700° C. for more than 10 hours, many nonmetallic products are allowed to exist at the starting powder particle boundaries to impair toughness of the composition after consolidation. Therefore, the holding temperature before consolidation is preferably restricted to the range of 200° C. to 700° C., and the holding time is preferably 1 to 10 hours.

The mechanical properties of the ferritic steel obtained after consolidation are mostly dependent on the crystal grain size. According to the present invention, it is possible to obtain a structural strength surpassing 1,000 MPa while maintaining the same level of toughness—about 1 MJ/m$^2$ of Charpy impact value—as the conventional ferritic steels.

It is hardly possible to obtain this level of strength and toughness with the conventional precipitation strengthening method, solid-solution strengthening method, heat treatment or powder metallurgy method.

Other objects, features and advantages of the invention will become apparent from the following description of the embodiments of the invention taken in conjunction with the accompanying drawings.

EXAMPLES

Example 1

Figure 1:
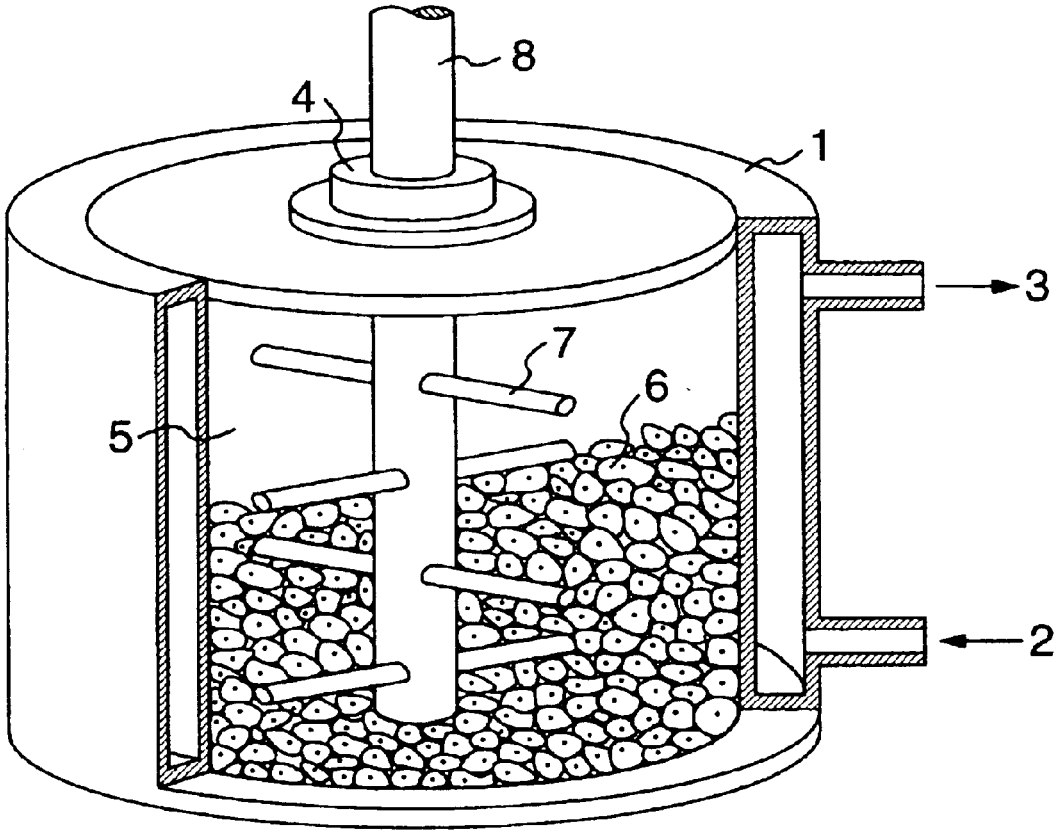
FIG. 1 is a perspective schematic view of an attrition mill used for mechanical pulverizing treatment.

FIG. 1 is a partially sectioned schematic perspective view of an attrition mill used for mechanical pulverization. The attrition mill comprises a 25-litre capacity pulverizing tank 1 made of stainless steel, a tank cooling water inlet 2, a cooling water outlet 3, a gas seal 4 for sealing the substitution gas such as argon or nitrogen gas, 5 kg of raw material mixed powder 5, 10 mm-diameter pulverizing steel balls 6 contained in the tank, and agitator arms 7.

Rotational driving force is transmitted to an arm shaft 8 from the outside to let the agitator arms 7 make a rotary motion. Steel balls 6 are agitated by the agitator arms and forced to collide against one another or against the inner wall of the tank 1, whereby the raw material mixed powder 5 is worked into a fine grain alloy powder. In this instance, the arm shaft rotating speed was set at 150 rpm, and the operation time was 100 hours.

To about 5 kg of an Fe-12Cr (corresponding to JIS SUS410L, and AISI 410) powder made by a gas atomizer, Zr powder was added in amounts of 0.5%, 1%, 2%, 4%, 6% and 8% by weight (Hf being added in amounts of 0.01%, 0.02%, 0.04%, 0.08%, 0.12% and 0.16% by weight; hereinafter the amounts of Hf added will be not mentioned), and each of the mixed powders was subjected to mechanical alloying (MA) treatment by using said attrition mill to make an alloy powder.

The chemical compositions (wt %) of the powders before and after mechanical alloying treatment are shown in Table 1. Each of the powders which have been subjected to MA was packed in a mild steel-made can and, after vacuum degassing and sealing, extruded at temperatures of 700° C., 800° C. and 900° C. at an extrusion rate of 5. The tensile strength and Charpy impact value of each extruded bodies after consolidation are shown in Table 2.

TABLE 1

| Specimen | | Fe | Cr | Zr | Hf | Si | Mn | P | S | O | C | N |
|---|---|---|---|---|---|---|---|---|---|---|---|---|
| Before MA | | bal | 12.8 | — | — | <0.01 | <0.01 | 0.001 | <0.001 | 0.03 | 0.002 | 0.002 |
| After MA | Zr 0.5% | bal | 12.3 | 0.55 | 0.01 | <0.01 | <0.01 | 0.005 | <0.001 | 0.05 | 0.04 | 0.005 |
| | Zr 1% | bal | 12.3 | 0.98 | 0.02 | <0.01 | <0.01 | 0.003 | 0.001 | 0.07 | 0.06 | 0.01 |
| | Zr 2% | bal | 12.4 | 1.97 | 0.04 | <0.01 | <0.01 | 0.003 | 0.001 | 0.08 | 0.06 | 0.015 |
| | Zr 4% | bal | 12.1 | 4.02 | 0.07 | <0.01 | <0.01 | 0.005 | <0.001 | 0.12 | 0.04 | 0.02 |
| | Zr 6% | bal | 12.2 | 5.04 | 0.11 | <0.01 | <0.01 | 0.004 | 0.001 | 0.11 | 0.05 | 0.015 |
| | Zr 8% | bal | 12.4 | 7.89 | 0.16 | <0.01 | <0.01 | 0.005 | 0.001 | 0.12 | 0.05 | 0.02 |

TABLE 2

| Extrusion temperature (° C.) | Additive amount of Zr (mass %) | Tensile strength (MPa) | Charpy impact value (MJ/m$^2$) |
|---|---|---|---|
| 700 | 0.5 | 1253 | 1.1 |
| | 1 | 1440 | 1.3 |
| | 2 | 1494 | 1.3 |
| | 4 | 1574 | 1.4 |
| | 6 | 1602 | 1.1 |
| | 8 | 1755 | 0.2 |
| 800 | 0.5 | 1049 | 3.3 |
| | 1 | 1180 | 3.5 |
| | 2 | 1237 | 3.1 |
| | 4 | 1305 | 2.6 |
| | 6 | 1320 | 2.4 |
| | 8 | 1356 | 0.4 |
| 900 | 0.5 | 1003 | 3.4 |
| | 1 | 1060 | 3.5 |
| | 2 | 1104 | 3.1 |
| | 4 | 1190 | 3.5 |
| | 6 | 1234 | 3.1 |
| | 8 | 1261 | 0.5 |

The materials extruded at 700° C. had 3 to 4 times higher strength than and substantially the same toughness as JIS SUS410L (AISI 410), and the materials extruded at 900° C. showed 2 to 3 times higher strength and substantially the same or greater toughness than JIS SUS410L.

There was noted a tendency for tensile strength to increase proportionally to the Zr content and to decrease with the rise of extruding temperature. Charpy impact value had generally a tendency to lower with the drop of extruding temperature.

There was also observed a sharp decreasing tendency of impact value when the Zr content was 8% at any extruding temperature. Each specimen presented a structure in which the fine particles were dispersed either in crystal grains or at grain boundaries. However, marked precipitation of compounds occurred at the grain boundaries in the specimens with 8% Zr.

According to the TEM observation of the precipitates in the metal structure, the specimens with Zr contents of 0.5 wt %, 1 wt %, 2 wt %, 4 wt % and 6 wt % were mainly composed of ZrC and $ZrO_2$, but the presence of ZrH, $HfO_2$, HfN and HfC was also confirmed. Also, each of the consolidated products had an average grain size of less than 1 μm, and the relationship between strength and grain size of these products can be accounted for by the Hall-Petch's relation.

Regarding Ti and Hf, the specimens were similarly prepared by adding these elements individually in Fe-12Cr powder by mechanical alloying and extruding the mixed powders. These specimens showed substantially the same tendency as the Zr-added specimen, but in the Ti-added specimen there was observed a tendency of toughness being badly impaired when the Ti content exceeded 3%, while in the Hf-added specimen exceeding reduction of toughness was seen when the Hf content exceeded around 10%. These results are attributable to the adverse effect of Ti and Hf when added in an excess amount over O, C and N.

The bulks with 2 wt % Zr content of 2 mass % were extruded at 700° C., 800° C. and 900° C. in extrusion ratios of 1.2, 1.5, 2.5, 8, 8.5 and 9. Presence or absence of pores as observed under a light microscope after extrusion of each specimen and the results of Charpy impact test are shown in Table 3.

Presence of pores in the materials was observed when the extrusion ratio was 1.2 and 1.5 at any extruding temperature. At 800° C. and 900° C., although extrusion could be conducted at the extrusion ratio of 8.5, separation took place in the Charpy impact test to exceedingly lower toughness. In order to elucidate the effect of addition of Zr, alloy powders were prepared by adding $ZrO_2$ to Fe-12Cr (corresponding to JIS SUS410L) powder made by a gas atomizer so that the Zr content would become 0.5 wt %, 1 wt %, 2 wt %, 4 wt % and 8 wt %, and subjecting the mixed powders to MA using an attrition mill. The chemical compositions before and after MA are shown in Table 4.

TABLE 3

| Extrusion temperature (° C.) | Extrusion ratio | Defects | Charpy impact value ($MJ/m^2$) |
|---|---|---|---|
| 700 | 1.2 | Present | 0.4 |
| | 1.5 | Present | 0.5 |
| | 2 | Absent | 1.0 |
| | 5 | Absent | 1.3 |
| | 8 | Absent | 1.4 |
| | 8.5 | Clogged | — |
| | 9 | Clogged | — |

TABLE 3-continued

| Extrusion temperature (° C.) | Extrusion ratio | Defects | Charpy impact value ($MJ/m^2$) |
|---|---|---|---|
| 800 | 1.2 | Present | 0.5 |
| | 1.5 | Present | 0.9 |
| | 2 | Absent | 2.8 |
| | 5 | Absent | 3.1 |
| | 8 | Absent | 1.9 |
| | 8.5 | Absent | 0.3 |
| | 9 | Clogged | — |
| 900 | 1.2 | Present | 0.5 |
| | 1.5 | Present | 0.8 |
| | 2 | Absent | 3.3 |
| | 5 | Absent | 3.1 |
| | 8 | Absent | 2.1 |
| | 8.5 | Absent | 0.5 |
| | 9 | Clogged | — |

TABLE 4

| Specimen | | Fe | Cr | Zr | Si | Mn | P | S | O | C | N |
|---|---|---|---|---|---|---|---|---|---|---|---|
| Before MA | | bal | 12.8 | — | <0.01 | <0.01 | 0.001 | <0.001 | 0.03 | 0.002 | 0.002 |
| After MA | $ZrO_2$ 0.7% | bal | 12.3 | 0.49 | <0.01 | <0.01 | 0.005 | <0.001 | 0.18 | 0.04 | 0.005 |
| | $ZrO_2$ 1.4% | bal | 12.3 | 1.01 | <0.01 | <0.01 | 0.003 | 0.001 | 0.38 | 0.05 | 0.01 |
| | $ZrO_2$ 2.7% | bal | 12.4 | 2.03 | <0.01 | <0.01 | 0.003 | 0.001 | 0.70 | 0.07 | 0.015 |
| | $ZrO_2$ 5.4% | bal | 12.1 | 3.94 | <0.01 | <0.01 | 0.005 | <0.001 | 1.42 | 0.05 | 0.02 |
| | $ZrO_2$ 10.8% | bal | 12.4 | 7.68 | <0.01 | <0.01 | 0.005 | 0.001 | 2.90 | 0.06 | 0.02 |

In order to avoid entering of O, C and N as much as possible during mechanical alloying treatment (MA), it was conducted in high-purity Ar gas, and the tank and balls were coated with JIS SUS410L (AISI 410) prior to the treatment. Extrusion was carried out at 800° C. in an extrusion ratio of 5. The results of the Charpy impact test on the extruded materials are shown Table 5.

TABLE 5

| Additive amount of $ZrO_2$, and Zr amount in the parentheses (mass %) | Charpy impact value ($MJ/m^2$) |
|---|---|
| 0.7 (0.5) | 0.3 |
| 1.4 (1.0) | 0.4 |
| 2.7 (2) | 0.2 |
| 5.4 (4) | 0.2 |
| 10.8 (8) | 0.1 |

Figure 2:
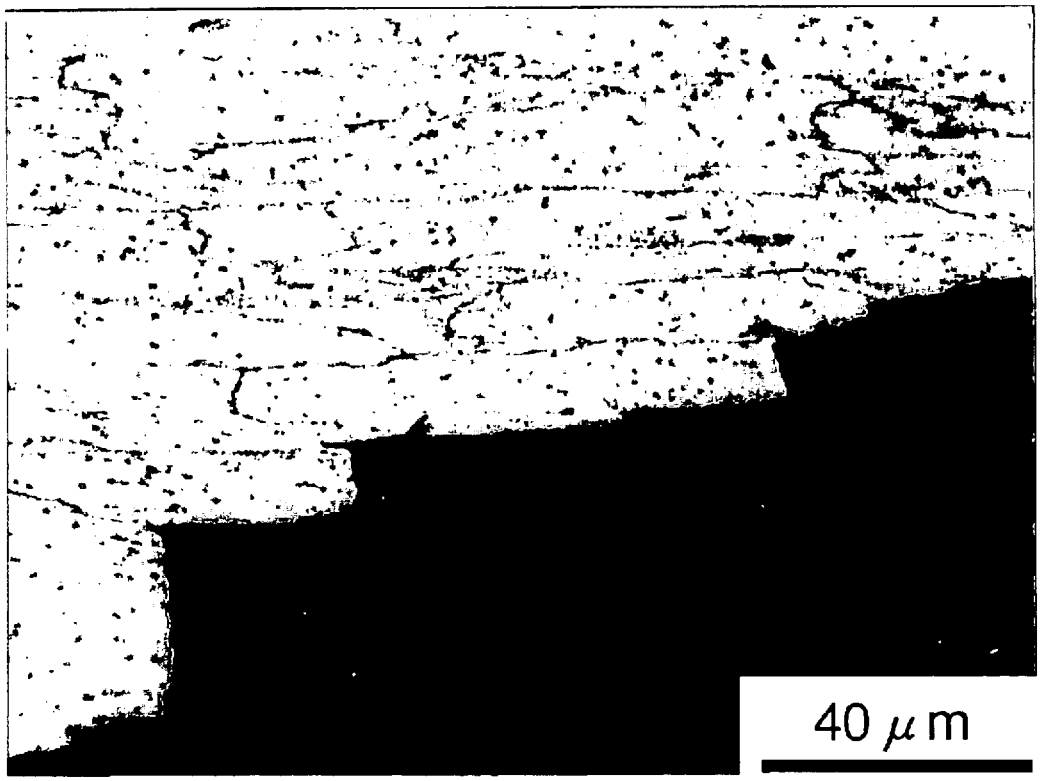
FIG. 2 is an optical micrograph showing the metal structure at and around a fractured surface in a Charpy impact test on a ferritic steel in an embodiment of the invention.

Use of $ZrO_2$ as the source of Zr contributed to the enhancement of strength but lowered impact value. An optical micrograph (after etching) of a fractured surface and its vicinity of a $ZrO_2$-added specimen (0.5% as Zr) is shown in FIG. 2. Etching clarified the shape of the powder particles before consolidation. It is also evident that fissure advanced along the powder particle boundaries.

The above specimen was cleaved in a vacuum chamber and the cleaved region was probed in the depth direction by Auger electron spectroscopical analyzer. As a result, it was found that mainly Cr oxides, Cr carbides and a small quantity of Cr nitrides were formed at the starting powder particle boundaries (surfaces). This is due to the adverse effect of O, C and N entered in MA.

MA powders were prepared by adding Ti, Zr and Hf simultaneously to Fe-12Cr powder and conducting MA so that O, C and N would be contained in amounts of about 0.3 wt %, 0.15 wt % and 0.14 wt %, respectively, and these MA powders were subjected to hot extrusion at 800° C. in an extrusion ratio of 5. The chemical compositions of the specimens after consolidation are shown in Table 6, and the results of the Charpy impact test on the consolidated products are shown in Table 7. Specimen A showed a tendency to fracture from the starting powder particle boundaries in the Charpy impact test, and the presence of comparatively coarse Cr carbide was admitted at the fractured surface (starting powder particle boundaries) and became the trigger point of cleavage fracture.

This is attributable to the small amounts of the getter elements Zr, Hf and Ti vis-à-vis the existing elements O, C and N. In specimen F, there was scarcely admitted the presence of Cr carbide, and the compounds mainly composed of the other elements Zr, Hf and Ti had a tendency to become the trigger point of cleavage fracture. This is due to the excessive amounts of Zr, Hf and Ti.

TABLE 6

| Specimen | Fe | Cr | Zr | Hf | Ti | Si | Mn | P | S | O | C | N |
|---|---|---|---|---|---|---|---|---|---|---|---|---|
| A | bal | 12.8 | 0.21 | 0.4 | 0.3 | <0.01 | <0.01 | 0.001 | <0.001 | 0.36 | 0.19 | 0.18 |
| B | bal | 12.3 | 2.2 | 4.1 | 1.0 | <0.01 | <0.01 | 0.005 | <0.001 | 0.34 | 0.17 | 0.17 |
| C | bal | 12.8 | 2.6 | 5.0 | 1.3 | <0.01 | <0.01 | 0.001 | <0.001 | 0.35 | 0.19 | 0.18 |
| D | bal | 12.3 | 3.3 | 5.9 | 1.5 | <0.01 | <0.01 | 0.003 | 0.001 | 0.38 | 0.18 | 0.18 |
| E | bal | 12.7 | 3.7 | 6.2 | 1.8 | <0.01 | <0.01 | 0.001 | <0.001 | 0.39 | 0.19 | 0.18 |
| F | bal | 12.4 | 4.0 | 7.9 | 1.9 | <0.01 | <0.01 | 0.003 | 0.001 | 0.38 | 0.19 | 0.19 |

TABLE 7

| Specimen | Charpy impact value ($MJ/m^2$) |
|---|---|
| A | 1.2 |
| B | 2.4 |
| C | 2.3 |
| D | 1.9 |
| E | 0.8 |

Example 2

The principal chemical components (wt %) of the invention ferritic steel specimens are shown in Table 8. Steel Nos. 1 to 3 were prepared to have a composition of 12 chrome steel, Steel Nos. 4 to 6 were prepared to have a composition of 18 chrome steel, and Steel Nos. 7 and 8 were prepared to have a composition of 25 chrome steel.

Steel Nos. 3, 6 and 8 are not sintered materials but comparative materials prepared through melting/casting, solid-solutioning heat treatment at 1,100° C. and tempering heat treatment at 600° C.

Approximately 500 g of milled powder of each sintered material was filled under vacuum in a cylindrical vessel made of mild steel having 50 mm in outer diameter, 75 mm in height and 1 mm in thickness, and subjected to 4-hour hot isostatic pressing (HIP) under the conditions of 700° C. of temperature and 590 MPa of pressure to form a consolidated body. Alloy powders prepared to the compositions of respective steel samples were used as row powder materials.

The above alloy powders were prepared by the Ar gas atomization method. Regarding the sintered materials, as a result of optical microscopical observation of the metal structure after HIP treatment, there was observed no presence of inner vacancy, and it was confirmed that an almost perfect bulk specimen could be formed by 700° C. HIP treatment. Further, there was confirmed a tendency for pores to remain in the material when the HIP temperature was below 700° C. and the HIP pressure was lower than 590 MPa.

Table 9 shows average grain size and Vickers hardness of the bulk specimens of the various steel preparations shown in Table 8. Average grain size was determined by electron microscopical observation of the metal structure.

As is seen from Table 9, hardness of comparative material Nos. 3, 6 and 8 was below 200 Hv while hardness of each sintered material was above 400 Hv. It has been known that hardness of steel materials is substantially proportional to tensile strength, and the increase of this hardness is considered attributable to grain refining by mechanical grinding.

TABLE 9

| Steel No. | Average grain size (μm) | Hardness (HV) | Remarks |
|---|---|---|---|
| 1 | 0.13 | 537 | Invention steel |
| 2 | 0.12 | 541 | Invention steel |
| 3 | 22 | 195 | Comparative steel |
| 4 | 0.18 | 477 | Invention steel |
| 5 | 0.16 | 486 | Invention steel |
| 6 | 27 | 178 | Comparative steel |

TABLE 8

| Steel No. | Fe | O | C | N | Si | Mn | Cr | Mo | W | V | Nb | Ti | Zr | Hf | Ni | Remarks |
|---|---|---|---|---|---|---|---|---|---|---|---|---|---|---|---|---|
| 1 | bal | 0.08 | 0.05 | 0.01 | <0.01 | <0.01 | 12.3 | 0.9 | 1.2 | 0.3 | 0.6 | — | — | | 0.3 | Invention steel |
| 2 | bal | 0.07 | 0.04 | 0.01 | <0.01 | <0.01 | 12.2 | 0.8 | 2.2 | 0.2 | 0.4 | 1.1 | 2.2 | 5.9 | 0.3 | Invention steel |
| 3 | bal | 0.08 | 0.06 | 0.01 | <0.01 | <0.01 | 12.3 | 0.9 | 2.4 | — | — | — | — | | — | Comparative steel |
| 4 | bal | 0.08 | 0.06 | 0.01 | <0.01 | <0.01 | 18.3 | 0.9 | — | — | — | 0.6 | — | | — | Invention steel |
| 5 | bal | 0.08 | 0.06 | 0.01 | <0.01 | <0.01 | 18.4 | 0.8 | — | 0.2 | 0.4 | 0.4 | 0.9 | 2.1 | — | Invention steel |
| 6 | bal | 0.004 | 0.003 | 0.0003 | <0.01 | <0.01 | 18.2 | 0.9 | — | — | — | — | — | | — | Comparative steel |
| 7 | bal | 0.08 | 0.05 | 0.01 | <0.01 | <0.01 | 25.4 | 0.9 | — | — | — | 0.1 | — | 1.1 | — | Invention steel |
| 8 | bal | 0.005 | 0.05 | 0.0003 | <0.01 | <0.01 | 25.1 | 1.0 | — | — | — | — | — | — | — | Comparative steel |

TABLE 9-continued

| Steel No. | Average grain size (μm) | Hardness (HV) | Remarks |
|---|---|---|---|
| 7 | 0.19 | 442 | Invention steel |
| 8 | 31 | 155 | Comparative steel |

As a result of structural observation by an electron microscope, it was confirmed that the metal structure of each invention steel specimen shown in Table 8 had an α-ferrite phase as matrix and had Cr23C6 type and Cr7C3 type carbides precipitated therein. In these steel preparations, there was also confirmed the presence of MC type carbide, oxide and nitride formed by reaction of V, Nb, Ti, Zr and Hf with carbon.

In the tensile test conducted on the HIP treated Steel Nos. 1, 2, 4, 5 and 7, each steel specimen showed high strength above 1,000 MPa but had a tendency to break in the elastic region. Steel Nos. 2, 4, 5 and 7 in which at least one of Ti, Zr and Hf had been added showed plastic deformation beyond the elastic region.

Example 3

2 kg of milled powder of the compositions of Steel Nos. 1 and 2 in Example 2 was filled under vacuum in a can made of JIS SUS304 stainless steel and having outer measurements of 50×60×130 mm and 1.2 mm of thickness and subjected to HIP treatment under the conditions of 700° C. of temperature and 190 MPa of pressure for 4 hours.

Each specimen after HIP treatment was heated at 700° C. in the atmosphere without removing the outside can and then hot forged repeatedly until the reduction of area became 54%. Optical microscopical observation of the specimen structure after forging confirmed that there existed no inside voids and that the milled powder was almost perfectly consolidated by the above process. The mechanical properties of the specimens are shown in Table 10.

TABLE 10

| Steel No. | Average grain size (μm) | 0.2% yield strength (MPa) | Tensile strength (MPa) | Elongation (%) | Charpy impact sgrength ($MJ/m^2$) |
|---|---|---|---|---|---|
| 1 Material produced by 190 MPa HIP & forging | 0.15 | 1483 | 1699 | 5 | 0.3 |
| 2 Material produced by 190 MPa HIP & forging | 0.14 | 1605 | 1854 | 5 | 1.4 |
| 3 Material produced by melting/casting | 22 | 590 | 790 | 25 | 1.8 |

The materials produced by 190 MPa HIP and forging showed more than double as high 0.2% yield strength and tensile strength as the material produced by melting/casting. In the Charpy impact test, Steel No. 2 with high tensile strength showed higher impact value than Steel No. 1.

Observation of the fractured surfaces after the impact test showed that Steel No. 1 developed brittle fracture centering around the former powder particle boundaries and had the sections where the Cr carbide and oxide were the trigger point of fracture.

In Steel No. 2, on the other hand, there was observed no former powder particle boundary, and it had the ductile-fractured surfaces almost in its entire structure. This can be accounted for by the fact that Steel No. 2 contained Ti, Zr and Hf, and thereby formation of non-metallic inclusions at the starting powder particle boundaries was inhibited Example 4

Following the procedure of Example 1, a specimen was prepared by adding Zr in an amount of 2 wt % and conducting extrusion at 700° C. in an extrusion ratio of 5, and this specimen was heat treated in the atmosphere or in pressurized Ar gas (100 MPa and 980 MPa) at 800° C. for 3 hours, and then subjected to the Charpy impact test. Results are shown in Table 11.

TABLE 11

| Specimen (additive Zr of 2%, extruded at 700° C., extrusion ratio: 5) | Charpy impact value ($MJ/m^2$) |
|---|---|
| as extruded | 1.3 |
| 800° C. × 3h, in the atmosphere | 1.1 |
| 800° C. × 3h, 100 MPa, in Ar | 1.8 |
| 800° C. × 3h, 980 MPa, in Ar | 2.7 |

The specimen as extruded at 700° C. and the specimen subjected to the heat treatment in the atmosphere after extrusion remained almost unchanged or rather showed a declining tendency in Charpy impact value, but the specimens subjected to the heat treatment in pressurized Ar gas were improved in Charpy impact value, indicating that a heat treatment under a pressurized atmosphere is effective for improving toughness of steel material.

In the specimen heat treated in the atmosphere, there was confirmed formation of mostly Cr carbide at the starting powder particle boundaries. The specimens heat treated in pressurized Ar gas under 100 MPa and 980 MPa of pressure had a metal structure with such a degree of homogeneity that it was impossible to specify the spots which appeared to be the starting powder particle boundaries.

Example 5

A powder prepared according to Example 1 with mechanical alloying conducted by adding Zr in an amount of 2% by weight was extruded at 800° C. (extrusion ratio: 5) and subjected to consolidation process according to the heating pattern shown in FIG. 3.

In (a) to (g), the specimens were held at the respective specified temperatures for 10 hours, then heated to 800° C. and, after kept at this temperature for a specified period of time, extruded, and the extruded materials were consolidated. The structures of the obtained consolidated bodies were observed under a transmission electron microscope, and the average grain size was measured by the cutting method. The consolidated bodies were also subjected to a tensile test and a Charpy impact test. The determined grain size, tensile strength and Charpy impact value are shown in Table 12.

TABLE 12

| Sintering pattern * | Grain size (μm) | Tensile strength (MPa) | Charpy impact value ($MJ/m^2$) |
|---|---|---|---|
| (a) | 0.31 | 1298 | 0.9 |
| (b) | 0.32 | 1270 | 2.8 |
| (c) | 0.29 | 1339 | 3.0 |
| (d) | 0.27 | 1390 | 2.9 |
| (e) | 0.29 | 1340 | 2.9 |
| (f) | 0.30 | 1279 | 3.0 |
| (g) | 0.40 | 1211 | 3.0 |

Figure 3:
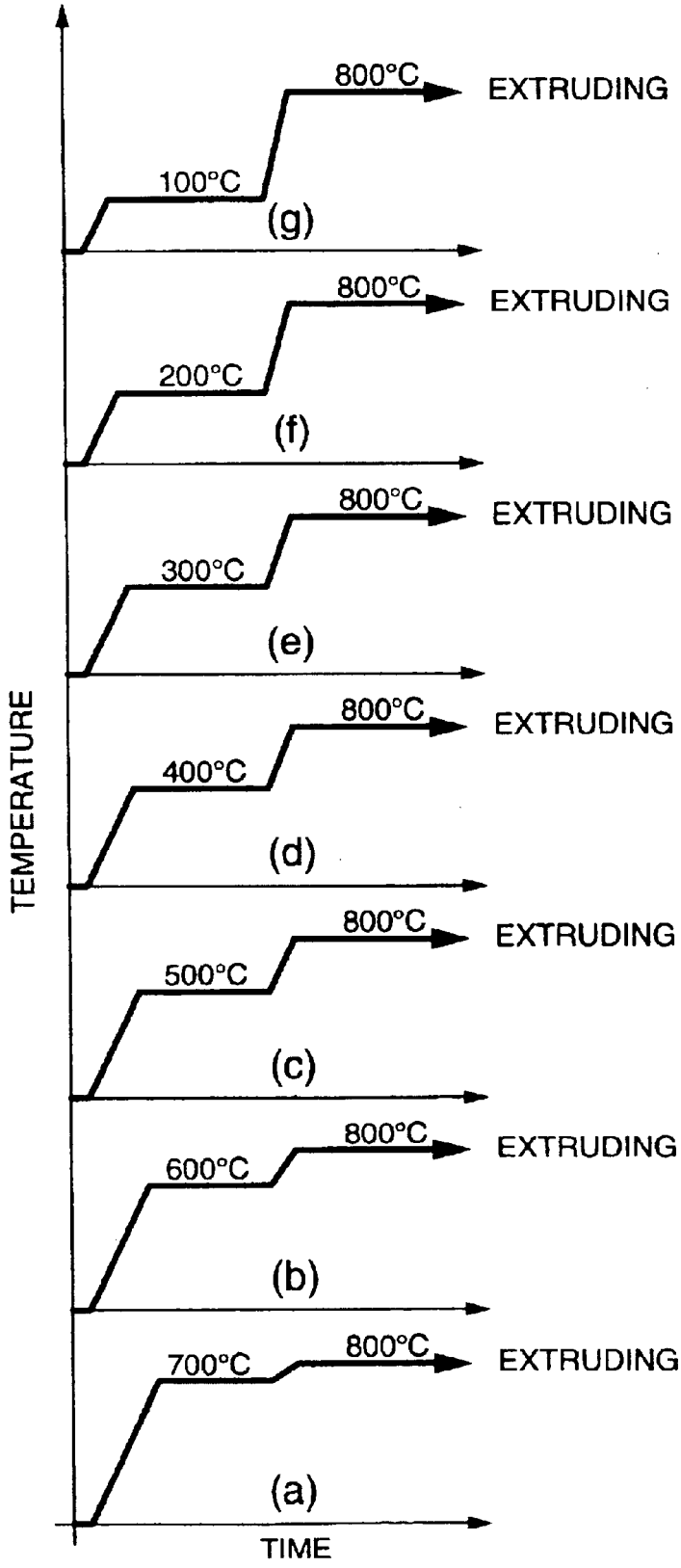
FIG. 3 is a graph showing the relationship between temperature and time in the heating patterns during consolidation in a ferritic steel producing method of the invention.

* Sintering pattern in the graph of FIG. 3.

The sizes of the particles dispersed in the consolidated bodies ranged from around 0.005 to around 0.05 μm in (a) and (b), and from around 0.002 to around 0.03 μm in (c), (d), (e), (f) and (g).

In the consolidated bodies made according to (b) to (f), as compared with the material extruded at 800° C. (same in Zr content and extrusion ratio) which was not held at the intermediate temperature referred to in Example 1, there was confirmed a significant improvement of strength with toughness maintained substantially unchanged. Since these can be accounted for by the same Hall-Petch relation, the above improvement of strength can be attributed to grain refining. The above results confirm that intermediate temperature retention is effective for maintaining the fine crystal structure.

On the other hand, no improvement of strength was admitted in (g). Also, in (a) where the powder was held at 700° C., there was observed a drop of toughness although strength was slightly improved, as compared with the material extruded at 800° C. (same in Zr content and extrusion ratio) which was not held at the intermediate temperature referred to in Example 1.

It was also experimentally confirmed that the specimen consolidated at 800° C. after having been held at 700° C. for 3 hours suffered almost no drop of toughness. Therefore, the drop of toughness in (a) is attributable to the long time (10 hours) retention at 700° C., or the formation of non-metallic inclusions at the former powder particle boundaries during retention (for 10 hours) at 700° C.

According to the present invention, as apparent from the foregoing Examples 1 to 5, it is possible to eliminate the brittlement factors peculiar to powder metallurgy and to provide a ferritic steel having high strength and high toughness specific to ultrafine grain steel materials by preventing generation of excessive harmful elements from the gaseous compositional elements contained in the materials and by letting the compounds formed by the reaction with the gaseous components function effectively as the pinning particles for controlling the growth of grains.

It should be further understood by those skilled in the art that the foregoing description has been made on embodiments of the invention and that various changes and modifications may be made in the invention without departing from the spirit of the invention and the scope of the appended claims.

What is claimed is:

1. A ferritic steel having high toughness and high strength, which consists essentially of, by weight, not more 1% Si, 8 to 30% Cr, each of C, N and O, the C, N and O being contained in amounts of more than 0%, and not more than 0.2% C, not more than 0.2% N, and not more than 0.4% O, a total amount of not more than 12% of at least one compound forming element selected from the group of Ti, Zr, Hf, V and Nb in amounts of not more than 3% Ti, not more than 6% Zr, not more than 10% Hf, not more than 1.0% V and not more than 2.0% Nb, and the balance of Fe and unavoidable impurities, and which has an average crystal grain size of not more than 1 μm, each of the C, N and O being combined with the at least one compound forming element.

2. A ferritic steel according to claim 1, wherein the compound forming element is at least one selected from the group of Ti, Zr and Hf a total amount of which is not more than 12% within respective content ranges of not more than 3% Ti, not more than 6% Zr and not more than 10% Hf.

3. A ferritic steel according to claim 2, wherein at least one of the compound forming element is selected from the group of Ti, Zr and Hf, and exists in the form of carbide, nitride and oxide.

4. A ferritic steel according to claim 2, wherein there are contained the compound forming elements of Ti, Zr and Hf in the steel, which exist in the form of carbide, nitride and oxide, respectively.

5. A ferritic steel according to claim 2, wherein there is contained any one of the compound forming elements of Zr, Ti and Hf in the steel, which exists in the form of carbide, nitride and oxide.

6. A ferritic steel according to claim 2, wherein there are contained the compound forming elements of Zr and Hf in the steel, Zr existing in the form of carbide and nitride, and Hf existing in the form of carbide, nitride and oxide.

7. A ferritic steel according to claim 2, wherein a total amount of O, C and N is less than 66 wt % of a total amount of Zr, Ti and Hf.

8. A ferritic steel according to claim 6, wherein a total amount of O, C and N is less than 66 wt % of a total amount of Zr and Hf.

9. A ferritic steel having high toughness and high strength, which consists essentially of, by weight, not more than 1% Si, not more than 1.25% Mn, 8 to 30% Cr, not more than 3% Mo, not more than 4% W, not more than 6% Ni, each of C, N and O, the C, N and O being contained in amounts of more than 0%, and not more than 0.2% C, not more than 0.2% N, not more than 0.4% O, a total amount of not more than 12% of at least one compound forming element selected from the group of Ti, Zr, Hf, V and Nb in amounts of not more than 3% Ti, not more than 6% Zr, not more than 10% Hf, not mare than 1.0% V and not more than 2.0% Nb, and the balance of Fe and unavoidable impurities, and which has an average crystal grain size of not more than 1 μm, each of the C, N and O being combined with the at least one compound forming element.

10. A ferritic steel according to claim 9, wherein there are contained the compound forming elements of Ti, Zr, Hf, V end Nb in the steel, which exist in the form of carbide, nitride and oxide, respectively.

11. A method of producing ferritic steel having high toughness and high strength, which comprises producing a steel powder by means of mechanical alloying, encapsulating the steel powder, and subjecting the encapsulated steel powder under heat to plastic deformation working whereby consolidating the steel powder, wherein the steel powder consists essentially of, by weight, not more than 1% Si, not more than 1.25% Mn, 8 to 30% Cr, each of C, N and O, the C, N and O being contained in amounts of more than 0%, and not more than 0.2% C, not more than 0.2% N, not more than 0.4% O, a total amount of not more than 12% of at least one compound forming element selected from the group of Ti, Zr, Hf, V and Nb in amounts of not more than 3% Ti, not more than 6% Zr, not more than 10% Hf, not more than 1.0% V and not more than 2.0% Nb, and the balance of Fe and unavoidable impurities, and the consolidated body of ferritic steel has an average crystal grain size of not more than 1 μm, and, in the ferritic steel, each of the C, N and O is combined with the at least one compound forming element.

12. A method according to claim 11, wherein the plastic deformation working is carried out at a temperature of 700° C. to 900° C.

13. A method according to claim 12, wherein the plastic deformation working is of extruding in an extrusion ratio of 2 to 8.

14. A method according to claim 12, wherein the plastic deformation working consists of a hydrostatic press forming process under a hydrostatic pressure of 190 MPa and a subsequent forging process.

15. A method according to claim 11, wherein after the plastic deformation working, the consolidated body is subjected to a heat treatment of heating to a temperature of 600° C. to 900° C. under a hydrostatic pressure of 10 to 1,000 MPa.

16. A method according to claim 11, wherein prior to the encapsulation, the steel powder is subjected to a heat treatment of holding it at a temperature of from not lower than 200° C. to lower than 700° C. for 1 to 10 hours.

17. A method according to claim 11, wherein when producing the steel powder, the plurality of different type raw powders are mixed with one another, the raw powders including at least one elemental powder of an element selected from a group of Zr, Hf and Ti, and another raw allay powder not containing Zr, Hf and Ti.

18. A method according to claim 11, wherein when producing the steel powder, a raw powder of $ZrO_2$ is used in order to add Zr into the steel.

19. A method according to claim 15, wherein the heat treatment is conducted in an Ar gas atmosphere.

20. A ferritic steel according to claim 1, wherein said at least one compound forming element is included in the ferritic steel in the form of carbide, nitride and oxide.

21. A ferritic steel according to claim 1, wherein C, N and O are contained in the ferritic steel in amounts of 0.002 to 0.15% C, 0.001 to 0.15% N and 0.02 to 0.2% O.

22. A ferritic steel according to claim 2, wherein Zr, Hf and Ti are contained in the ferritic steel, in amounts of 0.01 to 4% Zr, 0.01 to 8% Hf and 0.01 to 2.7% Ti.

23. A ferritic steel according to claim 7, wherein a total amount of O, C and N is less than 38 wt. % of a total amount of Zr, Ti and Hf.

24. A ferritic steel according to claim 2, wherein Zr and Hf are contained in the ferritic steel, and a total amount of O, C and N contained in the ferritic steel is less than 35% by weight of a total amount of Zr and Hf.

25. A ferritic steel according to claim 24, wherein the total amount of O, C and N contained in the ferritic steel is less than 17% by weight of the total amount of Zr and Hf.

26. A ferritic steel according to claim 2, wherein the at least one selected from the group of Ti, Zr and Hf inhibits the C, N and O from diffusing to particle boundaries of a starting powder for forming the ferritic steel and fixes the C, N and O in the form of carbides, nitrides and oxides in the powder.

27. A ferritic steel according to claim 1, wherein said at least one compound forming element combines with the C, N and O to form a carbide, nitride and oxide, the carbide, nitride and oxide being pinning particles in the ferritic steel for controlling the growth of crystal grains of the ferritic steel.

28. A method of producing ferritic steel having high toughness and high strength, which comprises producing a steel powder by means of mechanical alloying, encapsulating the steel powder, and subjecting the encapsulated steel powder under heat to plastic deformation working whereby consolidating the steel powder, wherein the steel powder consists essentially of, by weight, not more than 1% Si, not more than 1.25% Mn, 8 to 30% Cr, not more than 3% Mo, not more than 4% W, not more than 6% Ni, each of C, N and O, the C, N and O being contained in amounts of more than 0%, and not more than 0.2% C, not more than 0.2% N, not more than 0.4% O, a total amount of not more than 12% of at least one compound forming element selected from the group of Ti, Zr, Hf, V and Nb in amounts of not more than 3% Ti, not more than 6% Zr, not more than 10% Hf, not more than 1.0% V and not more than 2.0% Nb, and the balance of Fe and unavoidable impurities, and the consolidated body of ferritic steel has an average crystal grain size of not more than 1 μm, and, in the ferritic steel, each of the C, N and O is combined with the at least one compound forming element.

* * * * *